United States Patent [19]

Hudson, Jr. et al.

[11] Patent Number: 5,022,376

[45] Date of Patent: Jun. 11, 1991

[54] OIL SEPARATOR FOR CRANKCASE FUMES

[75] Inventors: Sharon J. Hudson, Jr., Lambertville, Mich.; James D. Taylor, Toledo, Ohio

[73] Assignee: Cooper Industries, Inc., Houston, Tex.

[21] Appl. No.: 498,542

[22] Filed: Mar. 26, 1990

[51] Int. Cl.[5] ..... F02M 25/00

[52] U.S. Cl. ..... 123/572; 123/41.86

[58] Field of Search ..... 123/41.86, 572, 573, 123/574

[56] References Cited

U.S. PATENT DOCUMENTS

| | | | |
|---|---|---|---|
| 4,453,525 | 6/1984 | Debruler | 123/572 |
| 4,502,424 | 3/1985 | Katoh et al. | 123/41.86 |
| 4,565,164 | 1/1986 | Satoh et al. | 123/572 |
| 4,569,323 | 2/1986 | Okumura | 123/572 |
| 4,627,406 | 12/1986 | Namiki et al. | 123/572 |
| 4,723,529 | 2/1988 | Yokoi et al. | 123/41.86 |

FOREIGN PATENT DOCUMENTS

| | | | |
|---|---|---|---|
| 0039914 | 3/1984 | Japan | 123/572 |

*Primary Examiner*—Andrew M. Dolinar
*Assistant Examiner*—M. Macy
*Attorney, Agent, or Firm*—Harold F. Memsing

[57] ABSTRACT

An oil separator device for removing a substantial portion of the oil contained in the crankcase fumes of an internal combustion engine. The device is designed to be mounted on the inside of a rocker arm cover of the engine as a part of the crankcase ventilation system. Internal baffles direct a laminar flow of crankcase fumes through the separator canister along a folded path from an inlet in the bottom of the canister to an outlet in the top. Partially isolated channels extend along opposite edges of the flow path. Oil in the fumes attaches itself to the internal surfaces of the separator and flows down these surfaces, which are inclined, to a sump in the bottom. A tubular assembly connected to the bottom of the separator provides combined fume inlet and oil return passageways. The distal end of this tubular assembly has a special configuration which tends to prevent the upward flow of fumes through the oil return passageway, enhance the downward return flow of separated oil therein and prevent the reintroduction of returning oil into the fume stream inlet.

29 Claims, 4 Drawing Sheets

OIL SEPARATOR FOR CRANKCASE FUMES

BACKGROUND OF THE INVENTION

With the growing concern over air pollution, it has become imperative that crankcase fumes, generated during the normal operation of an internal combustion engine, not be vented into the atmosphere. Numerous crankcase ventilation systems have been developed which recirculate such fumes into the fuel-air intake of an engine. However, with the the high efficiency engines of today a serious problem is created when the recirculated fumes contain an excessive quantity of oil vapors or mist. The delicate fuel-air balance can be upset and improper combustion can occur with all of its attendent problems. Prior art oil separators for crankcase fumes have been used with only limited success. The problem appears to reside in achieving an acceptable balance between a separator's capability of separating oil vapors and mist from the crankcase fumes and its capability to return the separated oil to the engine from the separator. Accordingly, it is a general object of this invention to produce an oil separator which effectively separates an acceptable amount of oil from the crankcase fumes and has an enhanced capability of effectively making the collected oil available to the engine crankcase.

SUMMARY OF THE INVENTION

Generally speaking, this invention relates to an oil separator device for removing a substantial portion of the oil contained in the crankcase fumes of an internal combustion engine while the engine is in operation. The device is designed to be incorporated into the crankcase ventilation system as a component thereof. Preferably, it is mounted on the inside of a rocker arm cover of the engine. A plurality of superposed spaced apart internal baffle plate members direct a laminar flow of crankcase fumes through the separator canister along a continuous-fold type path from an inlet in the bottom of the canister to an outlet in the top. Partially isolated channels extend along opposite edges of the flow path. Oil in the fumes attaches itself to the internal surfaces of the separator and flows down these surfaces, which in their normal attitude are inclined towards a single drain corner, to a sump in the bottom of the separator. A tubular assembly connected to the bottom of the separator provides a fume inlet passageway and a parallel oil return passageway. The distal end of this tubular assembly is cut off at an acute angle which gives it a configuration that restricts the entry and upward flow of crankcase fumes into or through the oil return passageway, and enhances the collection and downward return flow of separated oil therein. This angular configuration provides a larger entrance opening than that provided by a square cut end. As a result of this increased peripheral length, the incoming fume flow velocity over the peripheral edge of the inlet is reduced. The reduced velocity enables return oil droplets, which form on the end of the assembly, to drop away without being reintroduced into the fume stream inlet particularly when the oil return passageway is located on the side of the tubular assembly which coincides with the tip of the cutoff end.

The advantages and features of the oil separator of this invention will be understood best if the detailed description is read with reference to the accompanying drawings.

DETAILED DESCRIPTION OF THE INVENTION

Figure 1:
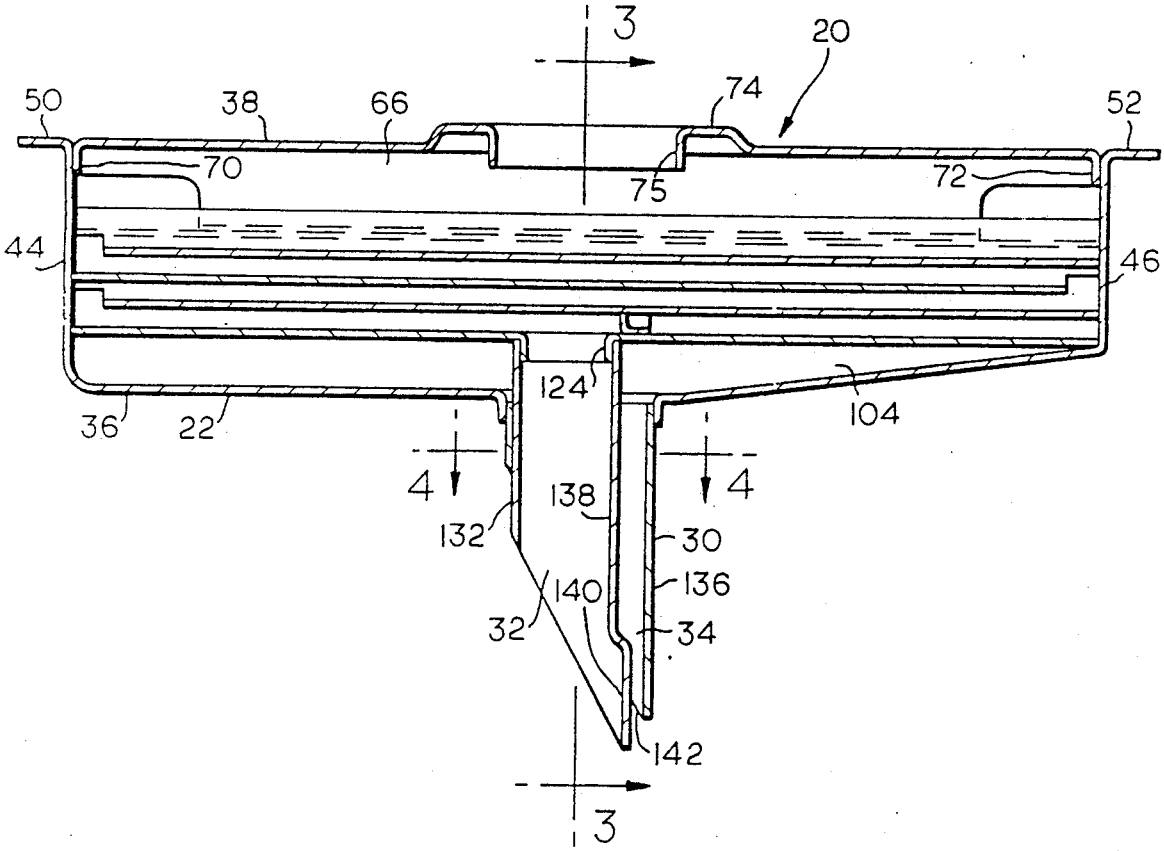
FIG. 1 is a sectional side view of a preferred embodiment of the oil separator of this invention.

Referring to the drawings it will be noted that the above mentioned oil separator device 20 is comprised basically of a canister 22, a plurality of superposed equally spaced baffle plate members 24*a*, 24*b*, 24*c*, 24*d* positioned inside the canister and a tubular assembly 30 affixed centrally in the bottom of the canister. The tubular assembly defines a fume inlet passageway 32 and a separated oil return passageway 34.

Figure 5:
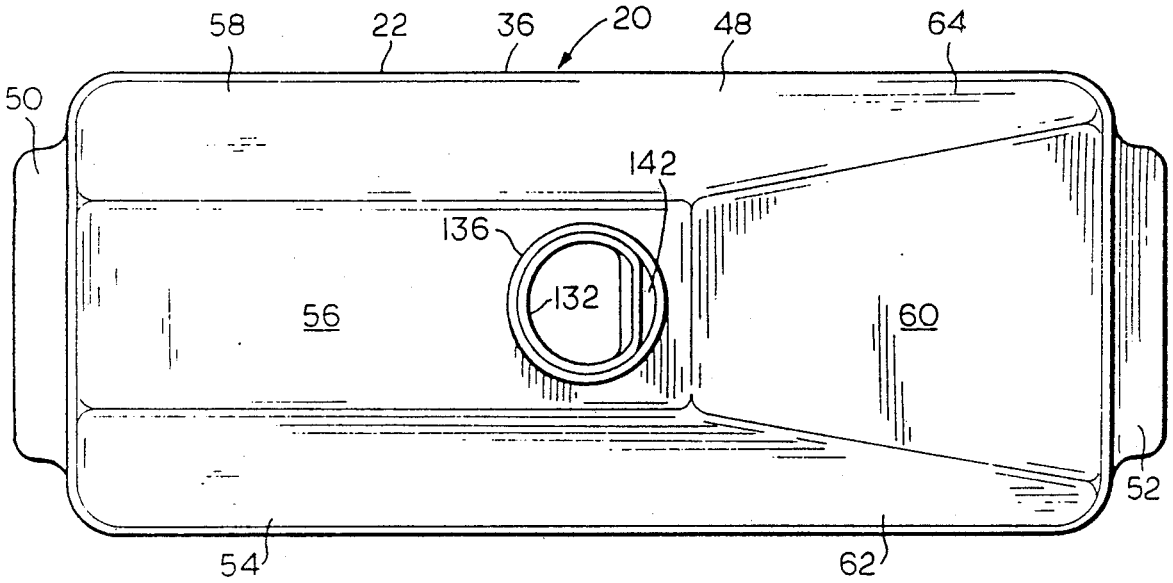
FIG. 5 is a bottom view of the oil separator.

Canister 22 has a generally rectangular boxlike shape formed by a pan member 36 and a top or cover member 38. Pan member 36 has upright side walls 40, 42, upright end walls 44, 46 and a boat shaped bottom 48. It may also have mounting or stabilizing flanges 50, 52 extending laterally outward from the top edges of the end walls. The aft portion of the bottom, that is the portion on the left of FIG. 5 which extends slightly to the right of center, is comprised of three rectangular panels 54, 56, 58 arranged side-by-side with the panels 54, 58 on opposite sides of the central panel 56 being angled upwardly therefrom. The forward portion of the bottom has an upwardly inclined truncated triangular central panel 60 with a pair of generally triangular side panels 62, 64 continuing respectively in the same planes as those of the aft side panels 54, 58. The primary objective of this bottom configuration is to provide surfaces which are sloped towards the inlet of the oil return passageway 34 when the canister is mounted in its normally tilted attitude inside a rocker arm cover of an automotive engine.

Canister cover member 38 has a generally flat top panel with side 66, 68 and end 70, 72 walls depending from its periphery. It also has an annular dome 74 surrounding a fume outlet means or collared aperture 75 in its center. The cover 38 is flush mounted on the inside of the top portion of the pan and sealed in place. Side walls 66, 68 extend deeper into the pan than the cover end walls and engage the edge of the top baffle 24*a* to forcibly hold the stack of baffle plate members together.

Figure 6:
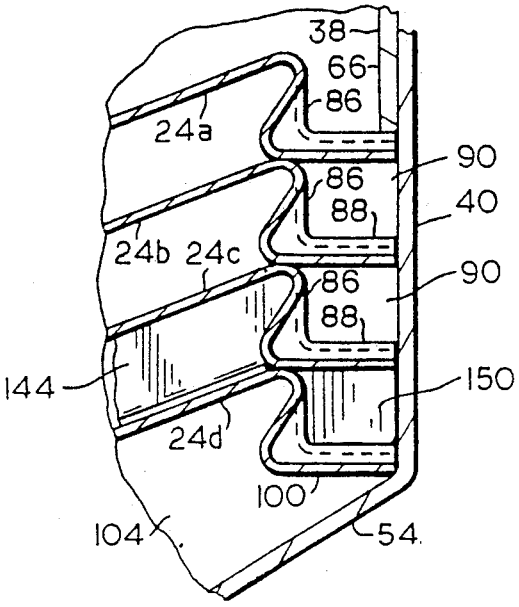
FIG. 6 is an enlarged fragmented view taken from an end of the oil separator showing cross sectional details of the foot sections, FIGS. 7 A,B,C and D are plan views of the respective baffle plate members from top to bottom.
Figure 7A:
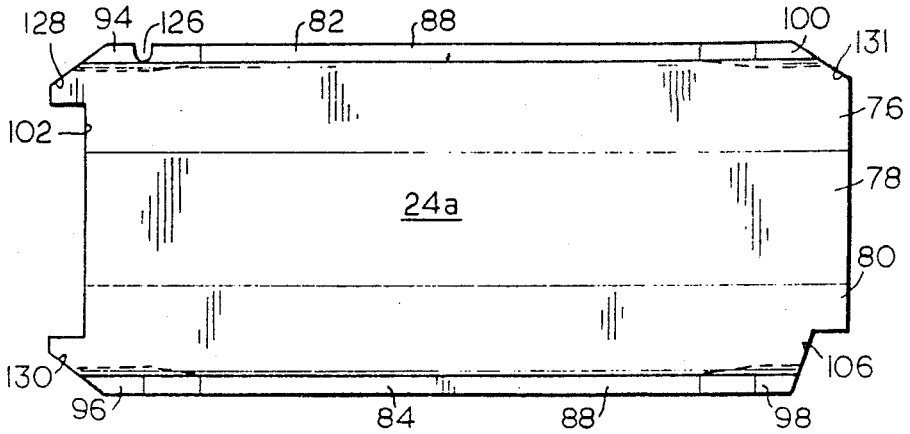
Figure 7B:
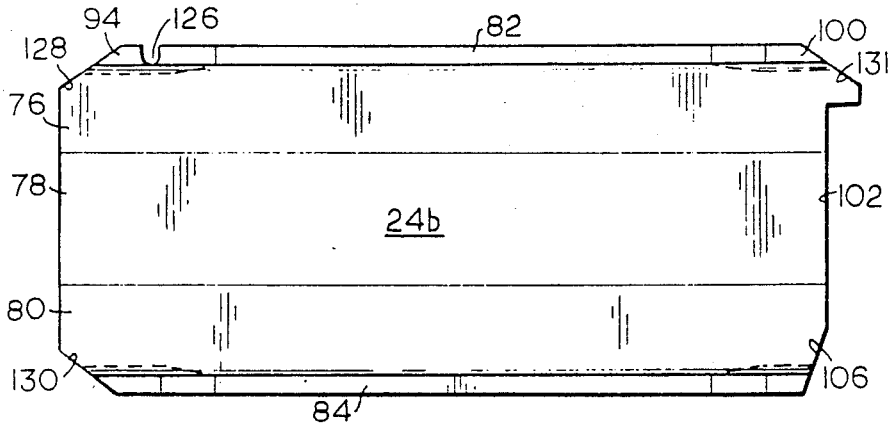
Figure 7C:
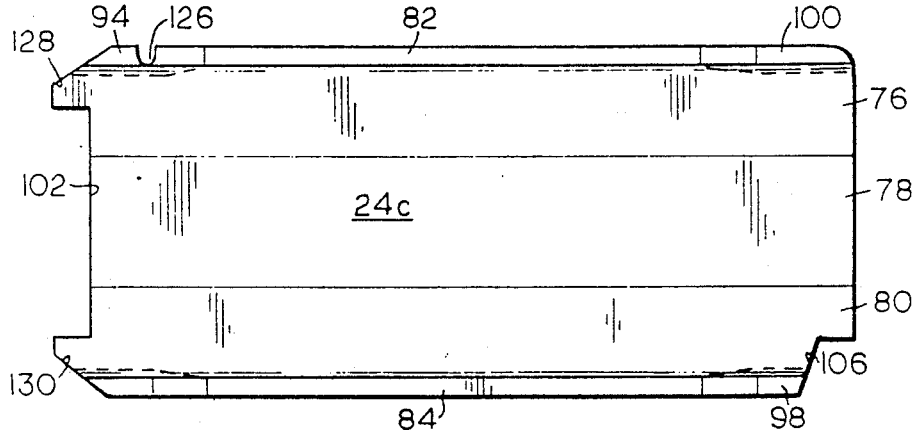
Figure 7D:
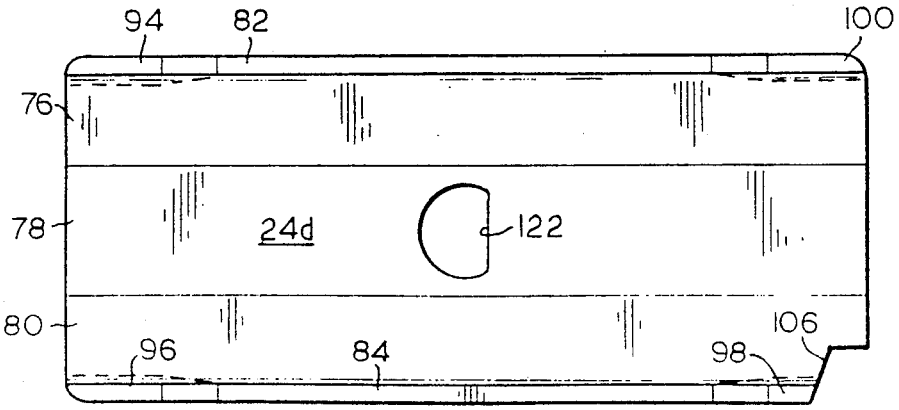

The baffle members 24*a*, 24*b*, 24*c*, 24*d*, corresponding respectively to the baffles shown in FIGS. *7a*, *7b*, *7c*, *7d*, are essentially alike in many respects so similar numbers are used to desiginate similar parts. They all have matching generally rectangular peripheral shapes and are preferably made from flat sheet material of uniform thickness. Each baffle plate member is comprised of three narrow rectangular flat panel sections 76, 78, 80 arranged side-by-side with the two side or wing panels 76, 80 being inclined upwardly relative to the central panel 78. Each baffle plate member also has "L" shaped step sections 82, 84 extending respectively along the outer longitudinal edge or side of each wing panel 76, 80 and depending therefrom. The riser 86 and tread 88 portions of the "L" shaped step sections in combination with the adjoining sidewall surfaces of the pan member define side channels 90, 92. The ends of the step sections are offset downwardly and inwardly to provide a foot 94, 96, 98, 100 adjacent to each of the four corners, respectively, of each baffle plate member for supporting the baffle plate members in a stacked relationship as illustrated in the drawings. The inward displacement is sufficient to allow the inside corner edge of each foot to rest on the top corner of the step below it (see FIG. 6). The downward displacement of each foot raises the intermediate portions of the steps and produces a narrow gap or slot aperture between these portions of the superposed steps, i.e. the bottom corner of this portion of each step is about 0.030 of an inch above the top corner of the step below it and the slot length is about 4 inches. Preferably the length-to-width ratio of the slot aperture is between 100:1 and 200:1. The narrowness of the slot aperture serves to partially isolate the side channels 90, 92 from the main stream of fluids flowing through the central portion of the oil separating baffle means and thus these side channels are denoted quiescent zone channels. Each of the three separating baffle plate members 24*a*, 24*b*, 24*c* has a mainstream fume flow path orifice 102 extending crosswise at one end thereof. However, the orifices 102 are on alternate ends of succeeding baffle plate members in the series. This produces the continuous-fold type flow pattern through the separating means.

Figure 2:
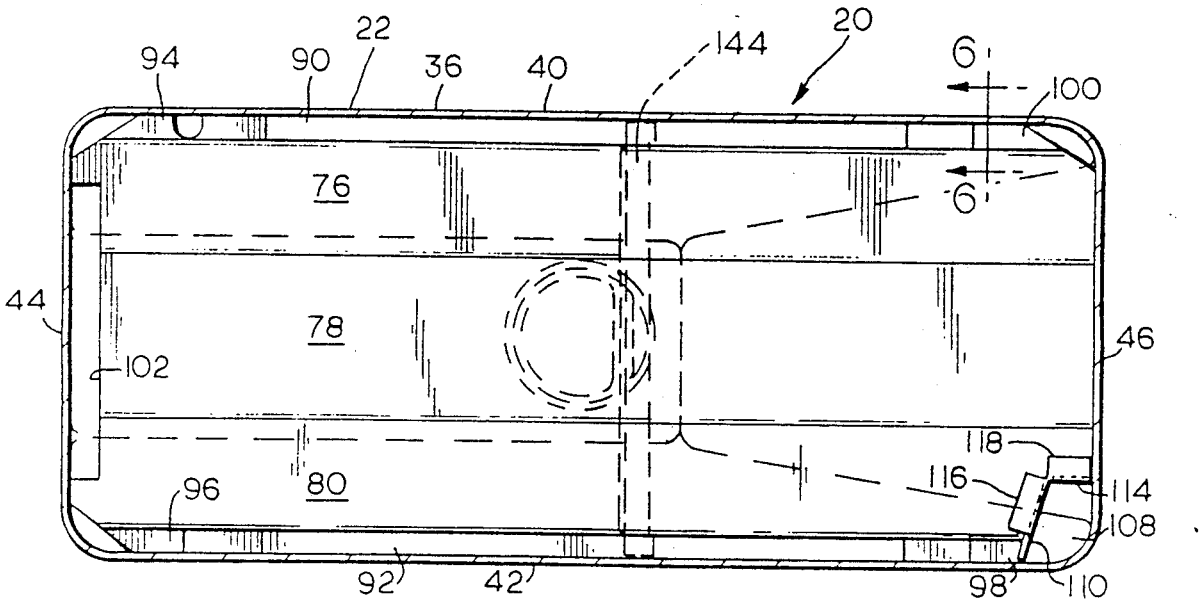
FIG. 2 is a sectional view taken along lines 2—2 of FIG. 3.
Figure 3:
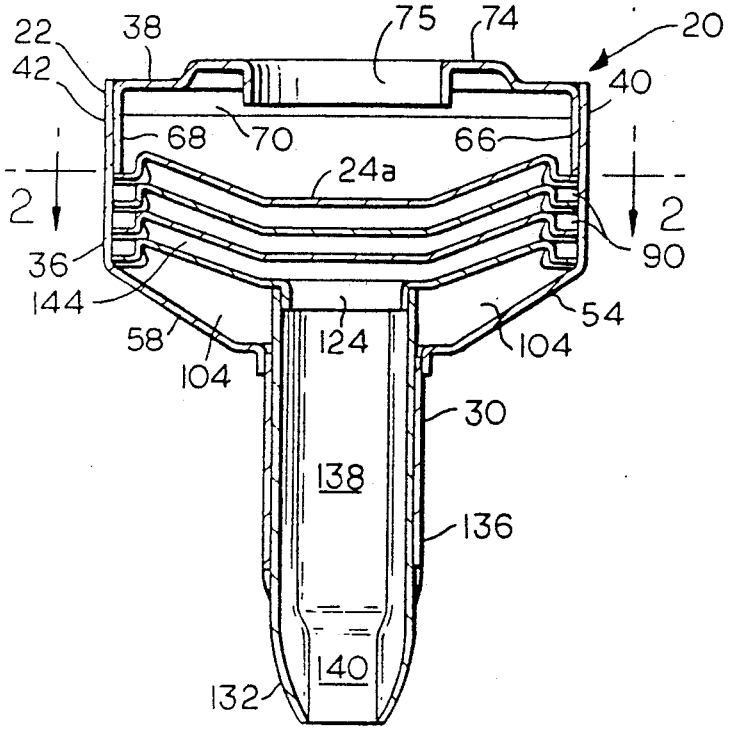
FIG. 3 is a sectional view taken along lines 3—3 of FIG. 1.
Figure 4:
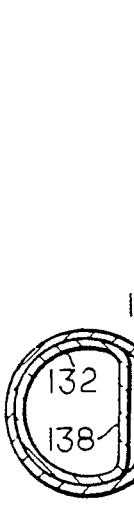
FIG. 4 is a sectional view of the tube assembly taken along lines 4—4 of FIG. 1.
Figure 8:
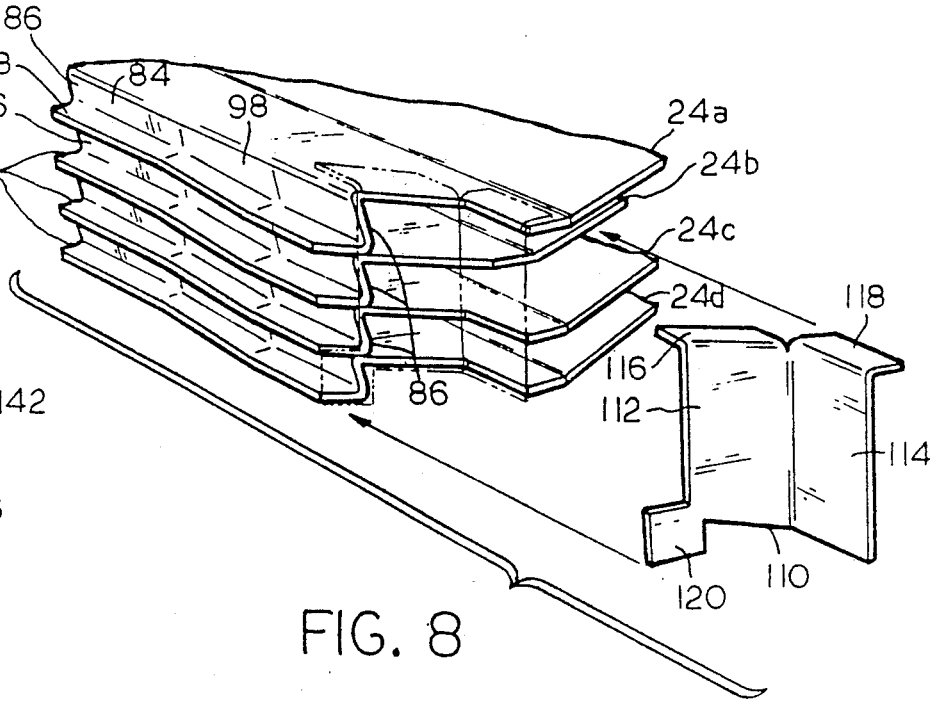
FIG. 8 is an exploded fragmented view in perspective of the interior elements of the drain corner of the oil separator.

The lower baffle member 24*d* in the superposed stack of baffle members cooperates with the bottom portion of the pan member to define the oil separator sump 104. The only access to the sump from above is through an opening formed by a single cutaway corner 106 of the lower baffle. A vertically disposed passageway, denoted the drainback passageway 108, is produced by this opening and the corresponding cutaway corners 106 of the other three baffles. It is located at the lowest corner of the separator when the separator is oriented in its normally inclined attitude in the engine. A drain dam 110 blocks the flow of fluid between the drain passageway and the flow path passegeways, defined by the baffle plate members, except for the flow of fluid between the drain passageway and some of the quiescent channels, specifically the uppermost three quiescent channels (as shown in FIGS. 2 and 8). This dam comprises a flat main section 112 which extends laterally inward from the quiescent channel risers 86 along the facing edges of the cutaway corners 106 of the baffles in tight contact therewith to a laterally disposed flat wing section 114 extending directly to the adjacent end wall 46 of the pan member at right angles thereto. Wing section 114 is located in a position which is equivalent to the adjoining end of a flow path orifice 102. Hanger flaps 116, 118 at the top of each dam section extend over the corner of baffle plate member 24*a* and are affixed thereto to support the dam member in position. A tab section 120 at a lower corner of the main section 112 covers the end of the bottom quiescent channel. A "D" shaped inlet aperture 122, which in turn has an extruded collar 124 of corresponding shape depending from its periphery, is located in the center of lower baffle member 24*d*.

In addition to the flow path orifices 102 and the drain passageway corner cutaways 106, the separating baffle plate members 24*a*, 24*b*, 24*c* have shunt apertures of relatively smaller size which allow portions of the crankcase fumes to bypass the mainstream flow path through the separator (see FIG. 7). For example, each of these baffle plate members has a small semicircular cutout 126 in the edge of its foot section 94 adjacent to the corner diametrically opposite from the drain passageway corner. They also have a pair of cutaway corner shunt apertures 128, 130 at opposite corners in the same end. At the other end in the corner opposite from the drain passageway, the upper two baffle plate members 24*a*, 24*b* also have an additional cutaway corner shunt aperture 131.

The aforementioned tubular assembly 30 is comprised of an inner tube member 132, defining the crankcase fumes inlet passageway 32, fitted inside of and projecting beyond both ends of a cylindrical outer tube member 136. The ends of the tube members adjacent to the pan member, referred to herein as the upper ends, are square cut whereas their opposite or lower ends are cut on an angle, preferably less than 45 degrees, for example, at an angle of thirty degrees from their tubular axes. Inner tube member 132 has two offset parallel flat side sections 138, 140 disposed end to end and extending along a common side over the full length of the tube member. The internal cross sectional size and shape of the upper end of this inner tube member matches the external size and shape of the "D" shaped collar 124 around which it is fitted and sealed. The flat side of this "D" shaped collar faces the end of the separator which contains the drainback passageway 108. This arrangement serves to orient the tube assembly rotationally so that the oil return passageway of the tubular assembly also faces that end.

The outer surfaces of flat side sections 138, 140 cooperate with the confronting arcuate inside surface of the outer tube member to define corresponding first and second portions of the oil return passageway 34. Because flat section 140, defining the second or lower portion of the passageway, is offset laterally outward from flat section 138, towards the surrounding cylindrical outer tube member, the axial length and cross sectional area of the second portion of the oil return passageway is less than that of the first portion. It is to be noted also that the lower tip of flat section 140 projects below the adjoining tip of the outer member.

The illustrated geometric shape of the oil return passageway, particularly the cross sectional shape of both the upper and lower passageway portions as well as that of the restricted oil return outlet orifice 142 at the bottom end of the second portion, is believed to impede the flow of crankcase fumes upwardly into and through the oil return passageway and also promote the downward return flow of the separated oil out of the device. The upper end of the outer tube member is fitted inside of and sealed to an extruded annular collar protruding from the bottom of the pan member 36.

The angular cut on the lower end of the inlet tube member provides an oblong or elliptical opening. This angular cut is significant in two respects. First of all, it provides a point on the periphery of the opening that is lower than any other point thereof and secondly, it increases the length of the periphery over that of a square cut tube thus reducing the flow velocity of the fume at the edge of the opening particularly at the outermost or lower point of the opening. It should be noted that this lowest end of the inlet tube corresponds to the lowest point on the similarly but slightly greater angled outer tube.

Figure 9:
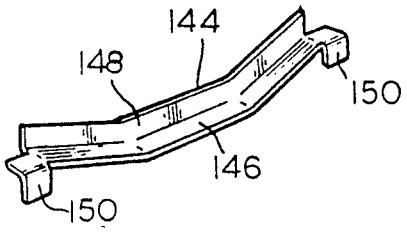
FIG. 9 is a perspective view of the bulkhead partition.

A bulkhead partition 144 is erected adjacent to the midsection of the separator, in the space between the bottom baffle 24*d* and the next baffle 24*c* above it in the stack, to block the flow of incoming crankcase fumes from flowing into the primary drainback end of the separator and to direct them towards the opposite end of the separator, i.e., towards the end of baffle 24*c* having the fume flow path notch 102 (on the left end of FIGS. 1 and 2). It also acts as a curb to direct any separated oil that accumulates on the surface of that end of baffle 24*d* into the flat or lower velocity side of the fume inlet tube. The bulkhead partition 144 (see FIG. 9) has an angular mounting flange 146 for attaching it to the bottom baffle 24*d*, such as by brazing, an angular upright blocking flange 148 shaped so as to close the primary space between the the aforementioned two baffles and a pair of depending tabs 150 to close off the side channels.

While the improved oil separator of this invention has been described with respect to a single illustrated embodiment, it is to be understood that various modifications may be made without departing from the scope of the invention which is defined primarily by the appended claims.

What is claimed is:

1. A device for separating oil from the crankcase fumes of an internal combustion engine during engine operation, said device comprising: a separator canister having a top, a bottom and peripheral side walls joining said top to said bottom, oil separating baffle means in said canister, a fume outlet in the top thereof, and an elongated tubular assembly in the bottom thereof, said tubular assembly defining a fume inlet passageway and a parallel oil return passageway, said tubular assembly being longer on one side than on the opposite side due to the geometry of its distal end, said return oil passageway being on said longer side.

2. An oil separating device according to claim 1 wherein said return oil passageway has a first section disposed upstream from an adjacent end of a second section, said second section having a lesser cross sectional area than said first section.

3. An oil separating device according to claim 2 wherein said first and second sections are defined by respective flat wall sections of an inner tubular member and confronting wall sections of an outer tubular member.

4. An oil separating device according to claim 1 wherein said tubular assembly has an inner tubular member and an outer tubular member, and the distal end face of said inner tubular member is disposed at an angle of 30 degrees with respect to its tubular axis to produce an opening with an oblong peripheral shape.

5. An oil separating device according to claim 1 wherein said tubular assembly has an inner tubular member and an outer tubular member, and the distal end of said inner member projects beyond the corresponding end of said outer member.

6. An oil separating device according to claim 5 wherein the opposite end of said inner tubular member extends beyond the adjacent end of said outer tubular member and is sealed to a collar surrounding a fume inlet aperture in a first baffle member adjacent to the bottom of said separating baffle means.

7. An oil separating device according to claim 6 wherein said collar is disposed inside said opposite end of said inner tubular member and said adjacent end of said outer tubular member is sealed to the inside of an annular collar projecting outwardly from said canister bottom.

8. An oil separating device according to claim 1 wherein said oil separating baffle means includes a plurality of spaced apart superposed oil separating baffle plate members having substantially rectangular shapes with fume flow orifices disposed across alternate ends to produce a continuous-fold type laminar mainstream flow path through the separator.

9. An oil separating device according to claim 8 wherein the cross sectional area of each fume flow orifice is at least as large as the cross sectional area between a pair of adjoining baffle plate members.

10. An oil separating device according to claim 8 wherein each of said baffle plate members has a flat central panel, upwardly inclined wing panels on opposite sides thereof and a step section on the outside of each wing panel.

11. An oil separating device according to claim 8 wherein each of said baffle plate members has a step section extending along each side and standoff feet adjacent to each corner such that the bottom of each foot rests on the top of a corresponding portion of the baffle plate member below it and the intermediate portions of said step sections are spaced from each other to form slot apertures, said step sections cooperate with the canister side walls to define quiescent zones extending along the outside of the mainstream flow path of fluid through the separator, said quiescent zones communicate with said mainstream through said slot apertures.

12. An oil separating device according to claim 11 wherein said slot apertures have a length-to-width ratio of between 100:1 and 200:1.

13. An oil separating device according to claim 11 wherein said device has a drain corner defined by angular corner cutaways of said baffle plate members, and a dam member in said drain corner, said dam member blocking the flow of fluid between said drain corner and the passageways defined by said baffle members except for fluid flow between said drain corner and some of said quiescent channels.

14. An oil separating device according to claim 8 wherein at least some of said baffle plate members have shunt apertures defined by cutaway corners for bypassing portions of the fluid flow around said mainstream flow path.

15. An oil separating device according to claim 8 further including a bulkhead partition between a first baffle member adjacent to the bottom of said canister and an adjacent baffle member, said bulkhead partition member being located adjacent to said fume inlet passageway.

16. A device for separating oil from the crankcase fumes of an internal combustion engine during engine operation, said device comprising: a separator canister having a top, a bottom and peripheral side walls joining said top to said bottom, oil separating baffle means in said canister, said oil separating baffle means includes a plurality of spaced apart superposed oil. separating baffle plate members having substantially rectangular shapes with fume flow orifices disposed across alternate ends to produce a continuous-fold type laminar mainstream flow path through the separator, each of said baffle plate members having a flat central panel, upwardly inclined wing panels on opposite sides thereof and a step section on the outside of each wing panel, a fume inlet means, a fume outlet means, and an oil return means,

17. An oil separating device according to claim 16 wherein the cross sectional area of each fume flow orifice is at least as large as the cross sectional area between a pair of adjoining baffle plate members.

18. A device for separating oil from the crankcase fumes of an internal combustion engine during engine operation, said device comprising: a separator canister having a top, a bottom and peripheral side walls joining said top to said bottom, oil separating baffle means in said canister, said oil separating baffle means includes a plurality of spaced apart superposed oil separating baffle plate members having substantially rectangular shapes with fume flow orifices disposed across alternate ends to produce a continuous-fold type laminar mainstream flow path through the separator, each of said baffle plate members having a step section extending along each side and standoff feet adjacent to each corner such that the bottom of each foot rests on the top of a corresponding portion of the baffle below it and the intermediate portions of said step sections are spaced from each other to form slot apertures, said step sections cooperate with the canister side walls to define quiescent zones extending along the outside of said mainstream flow path of fluid through the separator, said quiescent zones communicate with said mainstream through said slot apertures, a fume inlet means, a fume outlet means, and an oil return means.

19. An oil separating device according to claim 18 wherein said slot apertures have a length-to-width ratio of between 100:1 and 200:1.

20. An oil separating device according to claim 18 wherein said device has a drain corner defined by angular corner cutaways of said baffle plate members, and a dam member in said drain corner, said dam member blocking the flow of fluid between said drain corner and the passageways defined by said baffle members except for fluid flow between said drain corner and some of said quiescent channels.

21. A device for separating oil from the crankcase fumes of an internal combustion engine during engine operation, said device comprising: a separator canister having a top, a bottom and peripheral side walls joining said top to said bottom, oil separating baffle means in said canister, said oil separating baffle means includes a plurality of spaced apart superposed oil separating baffle plate members having substantially rectangular shapes with fume flow orifices disposed across alternate ends to produce a continuous-fold type laminar mainstream flow path through the separator, at least some of said baffle plate members having shunt apertures defined by cutaway corners for bypassing portions of the fluid flow around said mainstream flow path, a fume inlet means, a fume outlet means, and an oil return means.

22. A device for separating oil from the crankcase fumes of an internal combustion engine during engine operation, said device comprising: a separator canister having a top, a bottom and peripheral side walls joining said top to said bottom, oil separating baffle means in said canister, said oil separating baffle means includes a plurality of spaced apart superposed oil separating baffle plate members having substantially rectangular shapes with fume flow orifices disposed across alternate ends to produce a continuous-fold type laminar mainstream flow path through the separator, a bulkhead partition between a first baffle member adjacent to the bottom of said canister and an adjacent baffle member, said bulkhead partition member being located adjacent to said fume inlet means, a fume inlet means, a fume outlet means, and an oil return means.

23. A device for separating oil from the crankcase fumes of an internal combustion engine during engine operation, said device comprising: a separator canister having a top, a bottom and peripheral side walls joining said top to said bottom, oil separating baffle means in said canister, said oil separating baffle means includes a plurality of spaced apart superposed oil separating baffle plate members having substantially rectangular shapes with fume flow orifices disposed across alternate ends to produce a continuous-fold type laminar mainstream flow path through the separator, said fume inlet means and said oil return means are parallel passageways defined by an elongated tubular assembly in the bottom of said canister, said tubular assembly is longer on one side than on the opposite side due to the geometry of its distal end, said return oil passageway being on said longer side, a fume inlet means, a fume outlet means, and an oil return means.

24. An oil separating device according to claim 23 wherein said return oil passageway has a first section disposed upstream from an adjacent end of a second section, said second section having a lesser cross sectional area than said first section.

25. An oil separating device according to claim 24 wherein said first and second sections are defined by respective flat wall sections of an inner tubular member and confronting arcuate wall sections of an outer tubular member.

26. An oil separating device according to claim 23 wherein said tubular assembly has an inner tubular member and an outer tubular member, and the distal end face of said inner tubular member is disposed at an angle of 30 degrees with respect to its tubular axis to produce an opening with an oblong peripheral shape.

27. An oil separating device according to claim 23 wherein said tubular assembly has an inner tubular member and an outer tubular member, and the distal end of said inner member projects beyond the corresponding end of said outer member.

28. An oil separating device according to claim 27 wherein the opposite end of said inner tubular member extends beyond the adjacent end of said outer tubular member and is sealed to a collar surrounding a fume inlet aperture in a first baffle plate member adjacent to the bottom of said canister.

29. An oil separating device according to claim 28 wherein said collar is disposed inside said opposite end of said inner tubular member and said adjacent end of said outer tubular member is sealed to the inside of an annular collar projecting outwardly from said canister bottom.

* * * * *